US012252166B2

(12) United States Patent
Hu et al.

(10) Patent No.: US 12,252,166 B2
(45) Date of Patent: Mar. 18, 2025

(54) SAFETY MANAGEMENT METHOD OF TEMPORARY SPEED RESTRICTION FOR MULTIMODE TRAIN CONTROL SYSTEM

(71) Applicant: CASCO SIGNAL LTD., Shanghai (CN)

(72) Inventors: Ronghua Hu, Shanghai (CN); Xiaoyong Wang, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 239 days.

(21) Appl. No.: 18/013,258

(22) PCT Filed: Nov. 4, 2021

(86) PCT No.: PCT/CN2021/128595

§ 371 (c)(1),
(2) Date: Dec. 28, 2022

(87) PCT Pub. No.: WO2022/213588

PCT Pub. Date: Oct. 13, 2022

(65) Prior Publication Data

US 2023/0182792 A1 Jun. 15, 2023

(30) Foreign Application Priority Data

Apr. 7, 2021 (CN) ..... 202110371538.3

(51) Int. Cl.
*B61L 27/20* (2022.01)
*B61L 27/00* (2022.01)
*B61L 27/40* (2022.01)

(52) U.S. Cl.
CPC ..... *B61L 27/20* (2022.01); *B61L 27/00* (2013.01); *B61L 27/40* (2022.01); *B61L 2027/204* (2022.01)

(58) Field of Classification Search
None
See application file for complete search history.

(56) References Cited

U.S. PATENT DOCUMENTS 9,414,276 B2 * 8/2016 Zhang ..... H04W 36/0061
11,396,312 B2 * 7/2022 Ouyang ..... B61L 25/021
(Continued)

FOREIGN PATENT DOCUMENTS

CN 108163019 A * 6/2018 ..... B61L 15/00
CN 108609032 A * 10/2018 ..... B61L 19/06
(Continued)

*Primary Examiner* — Kevin R Steckbauer
(74) *Attorney, Agent, or Firm* — JCIPRNET

(57) ABSTRACT

A temporary speed restriction safe management method for a multi-mode train control system. The method comprises: step 101, issuing a temporary speed restriction setting instruction by means of a line network dispatching system; step 102, performing a validity check on a set temporary speed restriction, and setting a first mark-drawing up after the check is successful; step 103 setting a second mark-verification; step 104, feeding a verification state or verification failure of the set temporary speed restriction back to the dispatcher; step 105, an auxiliary dispatcher issuing an execution instruction for the verified temporary speed restriction; step 106, determining that the temporary speed restriction is successfully executed; step 107, feeding an execution state or execution failure of the temporary speed restriction back to the dispatcher; and step 108, sending the temporary speed restriction to a train of a corresponding system that passes through a speed restriction zone.

10 Claims, 4 Drawing Sheets

(56) References Cited

U.S. PATENT DOCUMENTS

| | | | | |
|---|---|---|---|---|
| 11,560,166 | B2 * | 1/2023 | Asuka | B61L 15/0027 |
| 2004/0006413 | A1 * | 1/2004 | Kane | B61L 15/0054 701/19 |
| 2005/0085961 | A1 * | 4/2005 | Kane | B61L 15/0036 701/19 |
| 2006/0041341 | A1 * | 2/2006 | Kane | B61L 15/0081 701/19 |
| 2019/0359237 | A1 * | 11/2019 | Ouyang | B61L 25/025 |
| 2021/0403061 | A1 * | 12/2021 | Asuka | B61L 23/14 |
| 2023/0058661 | A1 * | 2/2023 | Chen | B61L 27/70 |
| 2023/0182792 | A1 * | 6/2023 | Hu | B61L 27/00 701/19 |
| 2025/0026388 | A1 * | 1/2025 | Dunn | B61L 27/33 |

FOREIGN PATENT DOCUMENTS

| | | | | |
|---|---|---|---|---|
| CN | 108657236 | A * | 10/2018 | B61L 27/00 |
| CN | 108163019 | B * | 4/2020 | B61L 15/00 |
| CN | 111674431 | A * | 9/2020 | B61L 15/00 |
| CN | 108657236 | B * | 11/2020 | B61L 27/00 |
| CN | 112678027 | A * | 4/2021 | B61L 15/0072 |
| CN | 111232025 | B * | 6/2021 | B61L 27/04 |
| CN | 113022661 | A * | 6/2021 | B61L 27/00 |
| CN | 113401180 | A * | 9/2021 | |
| CN | 110949460 | B * | 11/2021 | B61L 27/0038 |
| CN | 113650652 | A * | 11/2021 | |
| CN | 113401180 | B * | 8/2022 | |
| CN | 112678027 | B * | 9/2022 | B61L 15/0072 |
| CN | 115257885 | A * | 11/2022 | B61L 27/10 |
| CN | 115384586 | A * | 11/2022 | |
| CN | 115384586 | B * | 3/2023 | |
| CN | 113830140 | B * | 9/2023 | |
| CN | 116834808 | A * | 10/2023 | |
| CN | 117533375 | A * | 2/2024 | |
| CN | 113911180 | B * | 4/2024 | B61L 27/00 |
| EP | 2746130 | A1 * | 6/2014 | B61L 15/0027 |
| EP | 2746130 | B1 * | 10/2020 | B61L 15/0027 |
| WO | WO-2022142495 | A1 * | 7/2022 | B61L 15/0072 |

* cited by examiner

SAFETY MANAGEMENT METHOD OF TEMPORARY SPEED RESTRICTION FOR MULTIMODE TRAIN CONTROL SYSTEM

CROSS-REFERENCE TO RELATED APPLICATION

This application is a 371 of international application of PCT application serial no. PCT/CN2021/128595, filed on Nov. 4, 2021, which claims the priority benefit of China application no. 202110371538.3, filed on Apr. 7, 2021. The entirety of each of the above mentioned patent applications is hereby incorporated by reference herein and made a part of this specification.

TECHNICAL FIELD

The present invention relates to a train signal control system, and, in particular, to a safety management method of temporary speed restriction for a multimode train control system.

BACKGROUND

At present, there are mainly two types of systems widely used in the field of operation control for rail transit in China, namely, a China train control system (CTCS) applied to trunk railway and a communication-based train operation control (CBTC) system applied to urban rail transit. A CTCS C2-level train control system is mainly applied to the trunk railway of 160-250 km/h in China, and the CBTC system for urban rail transit is based on the bidirectional information transmission of an LTE wireless network, and supports a line with a speed limit up to 200 km/h.

In order to meet the needs of the development of smart travel in urban clusters, the development guidelines and planning requirements for city-wide/intercity lines (railway/rapid railway) have been successively issued at national, local, and industrial levels in recent years. The interconnectivity among intercity railway, city-wide railway, and urban rail transit is an important tendency, and nowadays, a train control system compatible with the CBTC system and the CTCS has become a hot topic in the field of rail transit.

Temporary speed restriction is an important measure to ensure the safe operation of trains. During the actual operation of a train, temporary speed restriction control is often performed on a line according to line state, weather, maintenance and the like. Therefore, how to manage the temporary speed restriction safely and effectively to guarantee the safe operation of trains having a variety of systems on the line has become a technical problem to be solved currently.

SUMMARY

An object of the present invention is to fill in the gaps in the above prior art and to provide a safety management method of a temporary speed restriction for a multimode train control system.

The object of the present invention can be achieved by means of the following technical solutions.

According to one aspect of the present invention, there is provided a safety management method of temporary speed restriction for a multimode train control system. The method includes the following steps:

step 101, issuing, by a dispatcher, a temporary speed restriction setting instruction by means of a line network dispatching system;

step 102, receiving, by a temporary speed restriction server TSRS, the temporary speed restriction setting instruction issued by the line network dispatching system, checking validity of set temporary speed restriction, and setting a first symbol of establishment after the checking is passed;

step 103, determining, by the TSRS, that the set temporary speed restriction is verified as successful, and setting a second symbol of verification;

step 104, providing, by the TSRS, feedback on a verification state of the set temporary speed restriction or verification failed to the dispatcher;

step 105, issuing, by an assistant dispatcher, an execution instruction for the verified temporary speed restriction;

step 106, determining, by the TSRS, that the temporary speed restriction is executed successfully, and setting a third symbol of execution;

step 107, providing, by the TSRS, feedback on an execution state of the temporary speed restriction or execution failed to the dispatcher; and step 108, sending, by a train control system TCC and a zone controller ZC, the temporary speed restriction to a train, which has a corresponding system, passing a speed restriction zone.

As a preferred technical solution, determining, by the TSRS, that the set temporary speed restriction is verified as successful in step 103 specifically includes:

initiating verification to the associated TCC and ZC by the TSRS according to a starting point and an end point of the speed restriction zone, and after the verification is passed, determining, by the TSRS, that the temporary speed restriction is in a verified state.

As a preferred technical solution, determining, by the TSRS, that the verified temporary speed restriction is executed successfully in step 106 specifically includes:

issuing a temporary speed restriction execution instruction to the associated TCC and CBTC ZC by the TSRS according to a starting point and an end point of the speed restriction zone;

performing verification by the TCC and the ZC with respect to temporary speed restriction databases stored respectively by the TCC and the ZC; in case of state consistency, executing the temporary speed restriction execution instruction, and providing feedback to the TSRS; and after the TSRS acquires the feedback on execution from all the associated TCC and ZC, determining, by the TSRS, that temporary speed restriction information is executed successfully.

As a preferred technical solution, after determining that the set temporary speed restriction is executed correctly, the dispatcher determines that the temporary speed restriction is set successfully, or else, the dispatcher needs to reset the temporary speed restriction.

As a preferred technical solution, after the temporary speed restriction is executed successfully, a train having a CTCS-C2 system acquires temporary speed restriction information by means of the TCC, an LEU, or a transponder, and if the train having the CTCS-C2 system does not receive the temporary speed restriction information from the transponder as expected, a measure of directing to a safe side will be used.

As a preferred technical solution, in step 108, when an operation authority zone calculated by the ZC for a train having a CBTC system has an intersection with the temporary speed restriction zone, the temporary speed restriction information is sent to the corresponding train having the CBTC system by means of train-ground wireless communication, and the train having the CBTC system is safely controlled in operation according to the temporary speed restriction information and an operation authority.

As a preferred technical solution, after the temporary speed restriction is executed successfully, the TSRS stores the temporary speed restriction information-temporary speed restriction database, and does not actively request to the trackside TCC or ZC or synchronize the temporary speed restriction database, until receiving a new temporary speed restriction modification or an active synchronization request from the TCC/ZC after restart.

As a preferred technical solution, after the temporary speed restriction is executed successfully, the TCC and the ZC stores temporary speed restriction databases within ranges governed by the TCC and the ZC, such that, when the TSRS fails, management of the set temporary speed restriction is not affected; and after being restarted, the trackside TCC and ZC automatically makes an application to the TSRS for temporary speed restriction instruction synchronization, and if the synchronization is unsuccessful, the corresponding TCC or ZC performs execution according to most restrictive temporary speed restriction.

As a preferred technical solution, on-board equipment of the multimode train control system processes temporary speed restriction information received from a transponder or the ZC according to a current train operation control mode for safe control of train operation.

As a preferred technical solution, the dispatcher cancels the verification or the temporary speed restriction in the execution state by means of the line network dispatching system.

Compared with the prior art, the present invention can safely control the operation, on the same line, of trains provided with signal systems compliant with the C2 standards of China Railway or the CBTC standards for urban rails, and effectively issues temporary speed restriction. The present invention has the following advantages:

1) in the process of setting temporary speed restriction according to the present invention, the TSRS, TCC, and ZC perform safety management on the correctness of temporary speed restriction by means of three states including establishment, verification, and execution;
2) in the setting process according to the present invention, the operations of both establishment and verification are combined into one setting operation to optimize the current operation process of CTCS-C2 of China Railway, such that one operation step is omitted for a dispatcher during operation, which improves the operation efficiency;
3) in the verification and execution processes according to the present invention, the temporary speed restriction is considered as being verified or executed successfully only after passing the verification and execution of the TSRS and the TCC/ZC associated with the temporary line, which ensures the integrity of instruction verification and execution;
4) in the verification and execution processes according to the present invention, the setting and execution operations are performed by two different operators (a dispatcher and an assistant dispatcher) via different dispatchers, which ensures the correctness of the set temporary speed restriction, and effectively prevents maloperation and error setting caused by random system errors;
5) after the temporary speed restriction is set successfully according to the present invention, when the trackside TCC and ZC updates and stores a new temporary speed restriction database, there is no change in the temporary speed restriction database stored by the TSRS, or the trackside TCC and ZC is not restarted, the TSRS dos not exchange the temporary speed restriction database with the trackside TCC and ZC, which ensures the reliability and safety of the temporary speed restriction instruction, and moreover, the failure of central equipment such as the line network dispatching center and the TSRS does not affect the set temporary speed restriction, which improves the system usability;
6) after the temporary speed restriction is set successfully according to the present invention, the train having the CTCS-C2 system obtains temporary speed restriction information by means of the TCC/LEU/transponder, the train having the CBTC system obtains the temporary speed restriction information from the ZC by means of train-ground wireless communication, and the trackside equipment guarantee the independence of the CTCS C2 and CBTC systems without mutual interference, which makes the compatible on-board design simple at the same time; and
7) after the temporary speed restriction is set successfully according to the present invention, the ZC issues the temporary speed restriction information of the train having the CBTC system only when a movement authority calculated by the ZC for the train has an intersection with a zone associated with the temporary speed restriction instruction, which reduces the quantity of information of a train-ground wireless communication system, and improves transmission reliability.

DETAILED DESCRIPTION OF THE EMBODIMENTS

Figure 1:
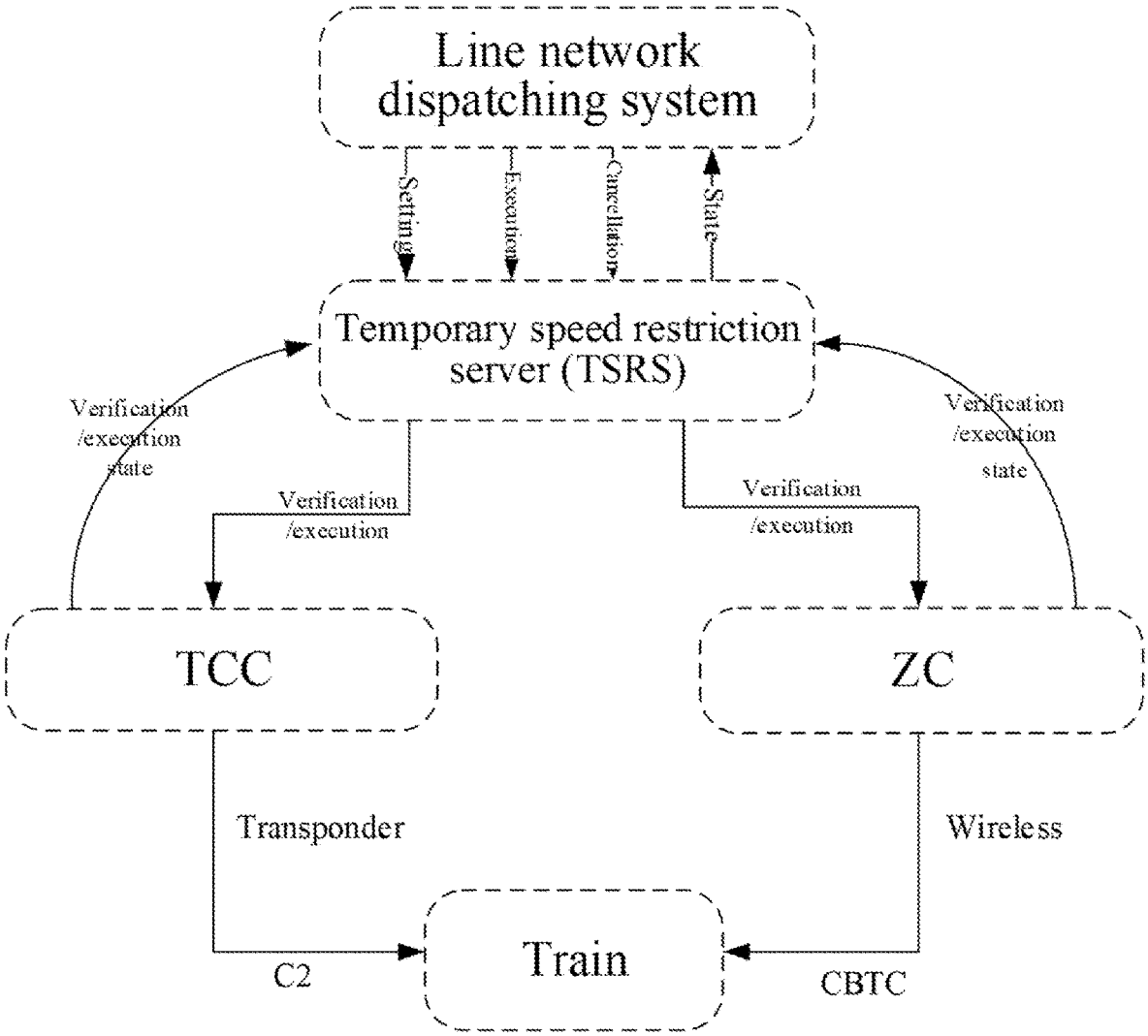
FIG. 1 is a flowchart of setting temporary speed restriction information by a multimode train control system.

The technical solutions in the embodiments of the present invention will be described clearly and completely below in conjunction with the accompanying drawings in the embodiments of the present invention. Obviously, the embodiments described are some instead of all of the embodiments of the present invention. Based on the embodiments in the present invention, every other embodiment obtained by those of ordinary skills in the art without creative labor shall fall within the protection scope of the present invention.

In order to meet the requirements of interconnected operation of city-wide railway, intercity railway, and urban rail transit, the present invention performs safe control on the operation, on the same line, of trains provided with the CTCS of China Railway, the CBTC system for urban rails, and the multimode train control system compatible with both the CTCS and the urban rail, and effectively sets temporary speed restriction, guaranteeing that the trains provided with train control systems compliant with various standards can operate safely on the lines.

The present invention provides a safety management method of temporary speed restriction for a multimode train control system. The method includes the following steps.

A dispatcher issues a temporary speed restriction setting instruction by means of a line network dispatching system.

A TSRS receives the temporary speed restriction setting instruction issued by the line network dispatching system. After the validity of temporary speed restriction information is successfully checked by the TSRS, a first symbol of establishment is set.

The TSRS initiates verification to the associated TCC and ZC according to a starting point and an end point of a speed restriction zone, and after the verification is passed, the TSRS determines that the temporary speed restriction information is verified successfully, and a second symbol of verification is set.

An assistant dispatcher issues execution with respect to the temporary speed restriction in the verification state; the TSRS issues executing the temporary speed restriction to the TCC and CBTC ZC according to a starting point and an end point of the speed restriction zone; and the TCC/ZC verifies that the temporary speed restriction is consistent with their respectively stored temporary speed restriction information of the verification state, and then provide feedback to the TSRS. After acquiring the feedback on execution from all the associated TCC and ZC, the TSRS determines that the temporary speed restriction information is executed successfully, and a third symbol of execution is set.

The TSRS set the temporary speed restriction instruction to an execution state and provide feedback to the dispatching system.

After confirming that all the temporary speed restriction is executed correctly, the dispatcher determines that the temporary speed restriction is set successfully, or else, the dispatcher needs to reset the temporary speed restriction.

After the temporary speed restriction is set successfully, a train having a CTCS-C2 system acquires the temporary speed restriction information by means of the TCC, an LEU, or a transponder, and if the train having the CTCS-C2 system does not receive the temporary speed restriction information from the transponder as expected, a measure of directing to a safe side will be used.

After the temporary speed restriction is set successfully, when an operation authority calculated by the ZC for a train having a CBTC system has an intersection with the temporary speed restriction zone, the temporary speed restriction information is sent to the corresponding train having the CBTC system by means of train-ground wireless communication, and the train having the CBTC system is safely controlled in operation according to the temporary speed restriction information and an operation authority.

After the temporary speed restriction is set successfully, the TSRS stores the temporary speed restriction database, and no longer actively makes a request to the trackside TCC or ZC or synchronize the temporary speed restriction database, until receiving a new temporary speed restriction update or an active synchronization request from the trackside TCC/ZC after restart.

After the temporary speed restriction is set successfully, the trackside TCC and the ZC stores temporary speed restriction databases within ranges governed by the TCC and the ZC, such that, when the TSRS fails, management of the set temporary speed restriction is not affected; and after being restarted, the trackside TCC and ZC automatically makes an application to the TSRS for temporary speed restriction database synchronization, and if the synchronization is unsuccessful, the corresponding trackside TCC or ZC performs execution according to most restrictive temporary speed restriction.

DESCRIPTION OF THE EMBODIMENTS

Figure 4:
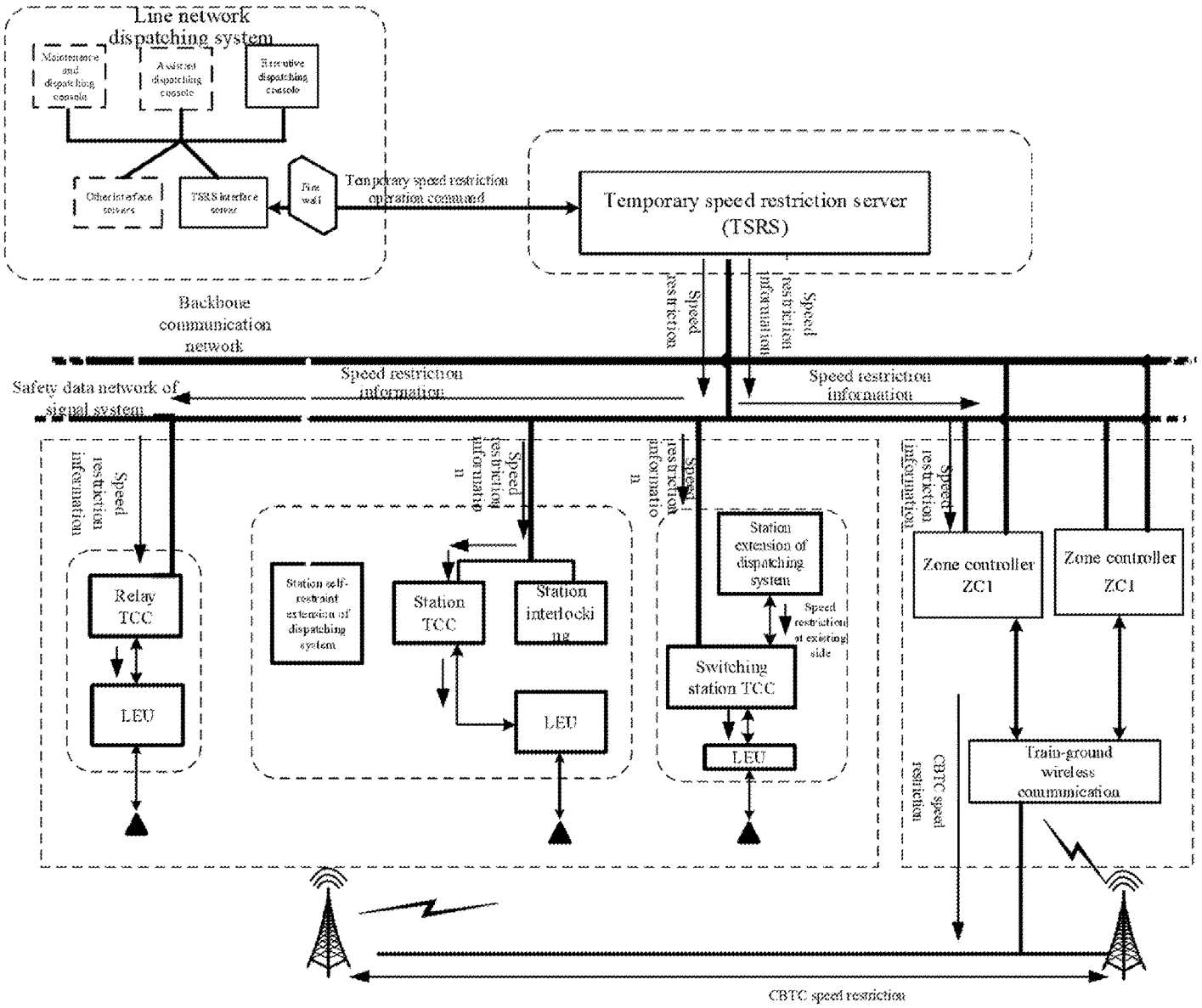
FIG. 4 is a general framework diagram of a multimode train control system.

A multimode train control system sets or cancels temporary speed restriction information in a center by means of an integrated line network dispatching center and a temporary speed restriction server. CTCS trackside equipment and CBTC trackside equipment (as shown in FIG. 4) are arranged at trackside at the same time. A CTCS train obtains the temporary speed restriction information by means of the TCC/LEU/transponder; and a CBTC-system train obtains the temporary speed restriction information from the ZC by means of train-ground wireless communication.

FIG. 1 is a flowchart of setting temporary speed restriction information by a multimode train control system. After obtaining a temporary speed restriction modification by means of the line network dispatching center, the TSRS issues the temporary speed restriction modification to a train, which is in a corresponding mode, passing through the temporary speed restriction zone by means of the TCC and the CBTC ZC, respectively.

Figure 2:
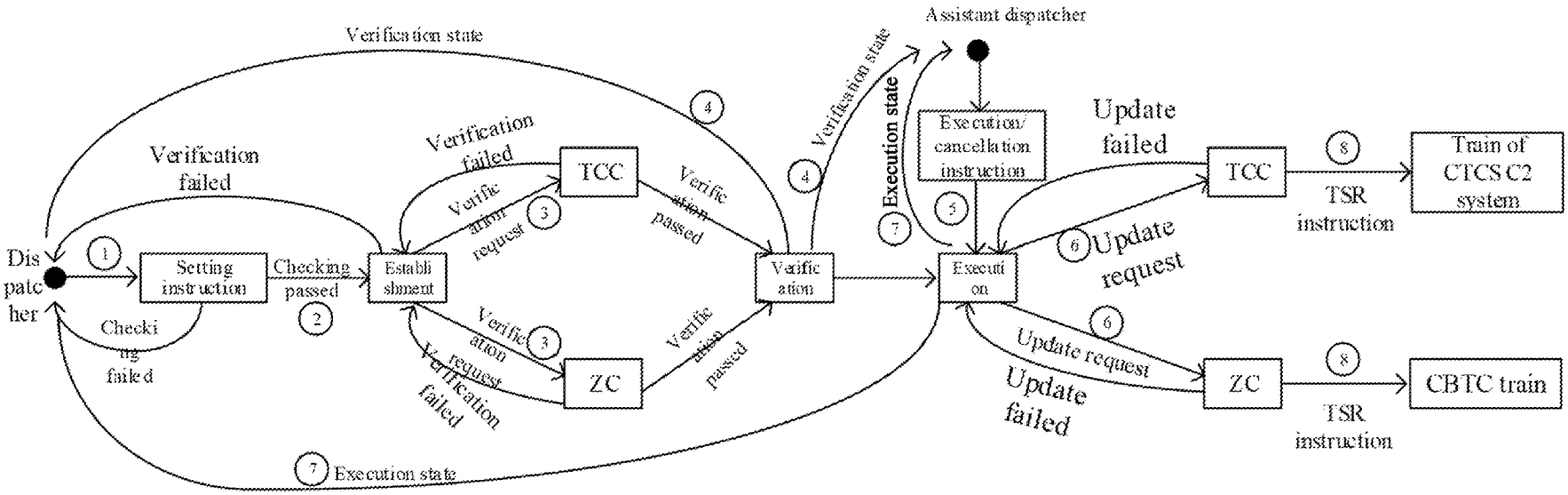
FIG. 2 is a state diagram of setting temporary speed restriction information by a multimode train control system.

There are three states for setting the temporary speed restriction instruction, namely, establishment, verification, and execution (FIG. 2). The establishment state can be achieved as long as the internal checking of the TSRS is passed. For the verification state, the TCC/ZC needs to confirm and provide feedback that the verification is passed, without sending the temporary speed restriction instruction to on-board equipment. The assistant dispatcher issues execution, the TSRS and all the associated equipment TCC/ZC check that the temporary speed restriction instruction to be executed is consistent with their stored temporary speed restriction instructions of the verification state, and then, it is ensured that the temporary speed restriction instruction is correctly received by the associated trackside equipment TCC/ZC. As such, the temporary speed restriction is set successfully.

This mainly includes the following steps.

In step 1, the dispatcher issues a temporary speed restriction instruction by means of a line network dispatching system.

In step 2, the TSRS receives the temporary speed restriction instruction issued by the line network dispatching system; and after the validity of the temporary speed restriction instruction is successfully checked by the TSRS, a first symbol of establishment is set. Or else, a checking failed prompt is returned to the dispatcher.

Figure 3:
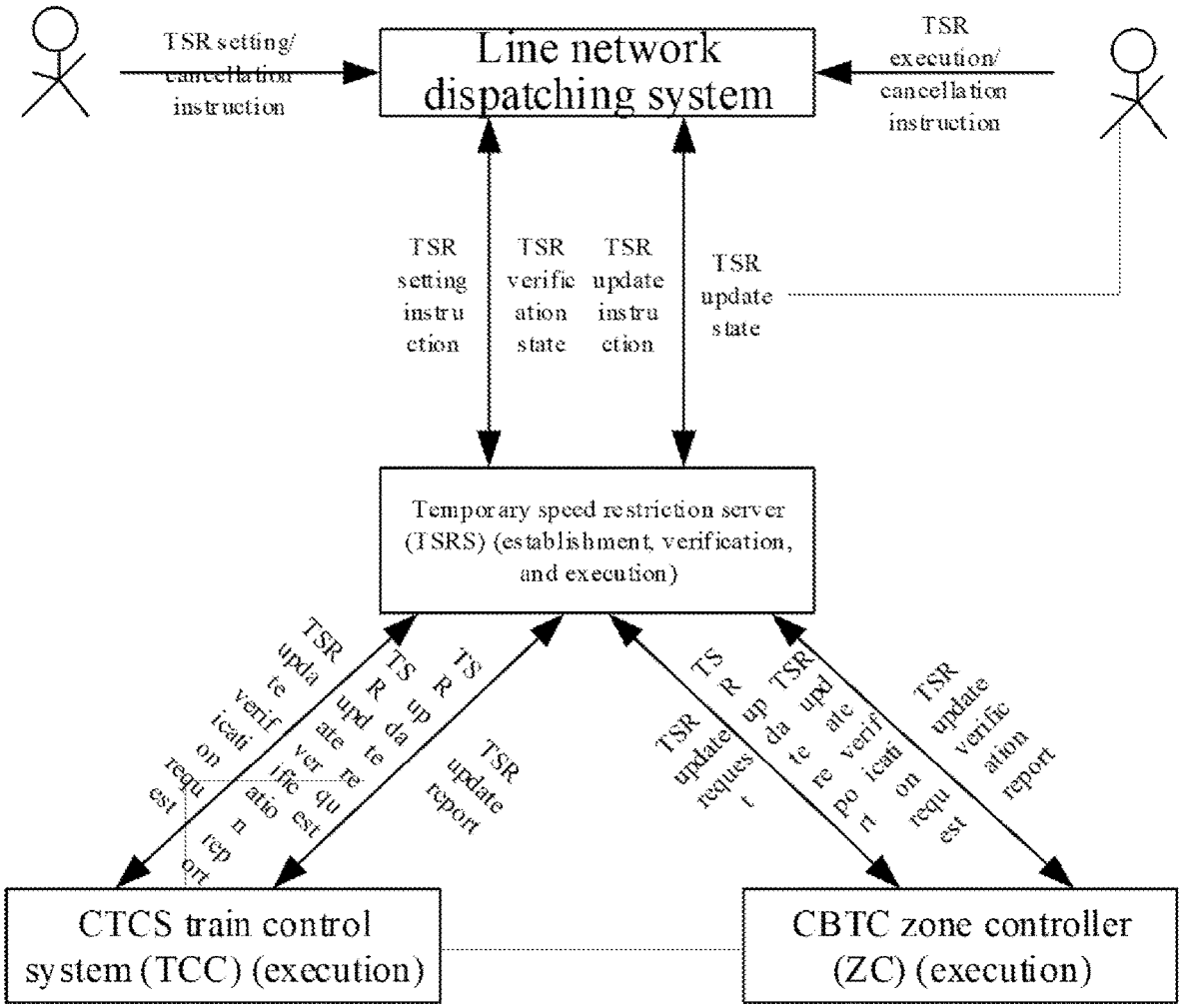
FIG. 3 is an exchange diagram of setting temporary speed restriction information by a multimode train control system.

In step 3, the TSRS initiates verification (as shown in FIG. 3) to the associated TCC and ZC according to a starting point and an end point of a speed restriction zone, and after the verification is passed, the TSRS determines that the temporary speed restriction information is verified successfully, and a second symbol of verification is set.

In step 4, the TSRS provides feedback on a verification state of the temporary speed restriction instruction or verification failed to the dispatcher.

In step 5, the assistant dispatcher issues an execution instruction for the set temporary speed restriction instruction.

In step 6, the TSRS issues a temporary speed restriction execution instruction to the TCC and CBTC ZC according to a starting point and an end point of the speed restriction zone; and the TCC/ZC verifies that the temporary speed restriction is consistent with their respectively stored temporary speed restriction instruction of the verification state, and then provide feedback to the TSRS. After acquiring the feedback on execution from all the associated TCC and ZC, the TSRS determines that the temporary speed restriction information is executed successfully, and a third symbol of execution is set.

In step 7, the TSRS provides feedback on an execution state of the temporary speed restriction instruction or execution failed to the dispatcher.

In step 8, a CTCS-C2-system train obtains the temporary speed restriction instruction by means of the TCC/LEU/transponder; when an operation authority calculated by the ZC for a train having a CBTC system has an intersection with the temporary speed restriction zone, the temporary speed restriction information is sent to the CBTC-system train by means of train-ground wireless communication; and the multimode train control system safely controls the operation of the train according to its current control mode.

In step 9, the dispatcher or assistant dispatcher may cancel the temporary speed restriction instruction in the verification or execution state by means of the line network dispatching system.

After the temporary speed restriction instruction is set successfully, the TSRS stores a temporary speed restriction database, and the trackside TCC or ZC after restart will actively make an application to the TSRS for synchronizing the temporary speed restriction database, in order to obtain the temporary speed restriction instruction within its governed range.

After the temporary speed restriction instruction is set successfully, the trackside TCC and ZC each store a new temporary speed restriction database, and in the case of the failure of center equipment such as the line network dispatching center and the TSRS, the temporary speed restriction instruction that has been set is not affected.

The above description only provides the specific embodiments of the present invention, and the protection scope of the present invention is not limited thereto. A variety of equivalent modifications or substitutions readily conceivable to a person skilled in the art within the technical scope disclosed by the present invention should be included within the protection scope of the present invention. Therefore, the protection scope of the present invention should be subjected to the protection scope of the claims.

What is claimed is:

1. A safety management method of a temporary speed restriction for a multimode train control system, comprising the following steps:

step 101, issuing, by a dispatcher, a temporary speed restriction setting instruction by means of a hardware processor of a line network dispatching system;

step 102, receiving, by a temporary speed restriction server (TSRS), the temporary speed restriction setting instruction issued by the hardware processor of the line network dispatching system, checking a validity of a set temporary speed restriction, and setting a state of a temporary speed restriction instruction as a first symbol of an establishment after the checking is passed;

step 103, determining, by the TSRS, that the set temporary speed restriction is verified as successful, and setting the state of the temporary speed restriction instruction as a second symbol of a verification;

step 104, providing, by the TSRS, feedback on a verification state of the set temporary speed restriction or the verification failed to the dispatcher;

step 105, issuing, by an assistant dispatcher, an execution instruction for the temporary speed restriction, which is verified;

step 106, determining, by the TSRS, that the temporary speed restriction is executed successfully, and setting the state of the temporary speed restriction instruction as a third symbol of an execution;

step 107, providing, by the TSRS, feedback on an execution state of the temporary speed restriction or the execution failed to the dispatcher; and step 108, sending, by a hardware processor of a train control system (TCC) and a zone controller (ZC), the temporary speed restriction to a train, which has a corresponding system, passing a speed restriction zone.

2. The safety management method of the temporary speed restriction for the multimode train control system according to claim 1, wherein determining, by the TSRS, that the set temporary speed restriction is verified as successful in the step 103 specifically comprises:

initiating the verification to the TCC and ZC, which are associated, by the TSRS according to a starting point and an end point of the speed restriction zone, and after the verification is passed, determining, by the TSRS, that the temporary speed restriction is in a verified state.

3. The safety management method of the temporary speed restriction for the multimode train control system according to claim 1, wherein determining, by the TSRS, that the temporary speed restriction, which is verified, is executed successfully in the step 106 specifically comprises:

issuing a temporary speed restriction execution instruction to the TCC and a communication-based train operation control (CBTC) ZC, which are associated, by the TSRS according to a starting point and an end point of the speed restriction zone; performing the verification by the TCC and the ZC with respect to temporary speed restriction databases stored respectively by the TCC and the ZC; in case of state consistency, executing the temporary speed restriction execution instruction, and providing the feedback to the TSRS; and after the TSRS acquires the feedback on the execution from all the TCC and ZC, which are associated, determining, by the TSRS, that the temporary speed restriction information is executed successfully.

4. The safety management method of the temporary speed restriction for the multimode train control system according to claim 1, wherein after determining that the set temporary speed restriction is executed correctly, the dispatcher determines that the temporary speed restriction is set successfully, or else, the dispatcher needs to reset the temporary speed restriction.

5. The safety management method of the temporary speed restriction for the multimode train control system according to claim 4, wherein after the temporary speed restriction is executed successfully, a train having a hardware processor of a China train control system C2-level (CTCS-C2 system) acquires the temporary speed restriction information by means of the TCC, an LEU, or a transponder, and if the train having the CTCS-C2 system does not receive the temporary speed restriction information from the transponder as expected, a measure of directing to a safe side will be used.

6. The safety management method of the temporary speed restriction for the multimode train control system according to claim 4, wherein in the step 108, when an operation authority zone calculated by the ZC for a train having a CBTC system has an intersection with a temporary speed restriction zone, the temporary speed restriction information is sent to the corresponding train having the CBTC system by means of train-ground wireless communication, and the train having the CBTC system is safely controlled in operation according to the temporary speed restriction information and an operation authority.

7. The safety management method of the temporary speed restriction for the multimode train control system according to claim 4, wherein after the temporary speed restriction is executed successfully, the TSRS stores the temporary speed restriction information-temporary speed restriction database, and does not actively request to the trackside TCC or ZC or synchronize the temporary speed restriction database, until receiving a new temporary speed restriction modification or an active synchronization request from the TCC/ZC after restart.

8. The safety management method of the temporary speed restriction for the multimode train control system according to claim 4, wherein after the temporary speed restriction is executed successfully, the TCC and the ZC stores temporary speed restriction databases within ranges governed by the TCC and the ZC, such that, when the TSRS fails, management of the set temporary speed restriction is not affected; and after being restarted, the trackside TCC and ZC automatically makes an application to the TSRS for temporary speed restriction instruction synchronization, and if the synchronization is unsuccessful, the corresponding TCC or ZC performs the execution according to most restrictive temporary speed restriction.

9. The safety management method of the temporary speed restriction for the multimode train control system according to claim 1, wherein on-board equipment of the multimode train control system processes temporary speed restriction information received from a transponder or the ZC according to a current train operation control mode for safe control of train operation.

10. The safety management method of the temporary speed restriction for the multimode train control system according to claim 1, wherein the dispatcher cancels the verification or the temporary speed restriction in the execution state by means of the hardware processor of the line network dispatching system.

* * * * *